United States Patent [19]

Christopher

[11] Patent Number: 5,035,344

[45] Date of Patent: Jul. 30, 1991

[54] CLOSURE FOR PORTABLE CONTAINER

[76] Inventor: Gary Christopher, 5211 La Jolla Blvd., La Jolla, Calif. 92037

[21] Appl. No.: 472,733

[22] Filed: Jan. 31, 1990

[51] Int. Cl.[5] ..... B65D 43/18

[52] U.S. Cl. ..... 220/336; 220/324; 215/236

[58] Field of Search ..... 220/264, 336; 215/236

[56] References Cited

U.S. PATENT DOCUMENTS 530,796 12/1894 Pratt ..... 220/264

*Primary Examiner*—Stephen Marcus
*Assistant Examiner*—Nova Stucker
*Attorney, Agent, or Firm*—Don J. Flickinger; Jordan M. Meschkow

[57] ABSTRACT

A panel like lid is secured to a receptacle by a pintle for pivotal movement between a closed position and an open position about an axis whereby the lid remains horizontal at all times. In the closed position, a continuous groove in the underside of the lid matingly receives a bead upstanding from the upper edge of the sidewall of the receptacle. A compression spring encircling the pintle normally urges the lid downwardly against the receptacle. In response to movement from the closed position toward the open position, the lid is cammed upwardly to disengage the groove from the bead.

1 Claim, 2 Drawing Sheets

CLOSURE FOR PORTABLE CONTAINER

BACKGROUND OF THE INVENTION

1. Field of the Invention

This invention relates to closures.

More particularly, the present invention relates to closures or lid assemblies of the type especially adapted for use in connection with portable containers such as commonly used for storage and transportation of food and drink.

In a further and more specific aspect, the instant invention concerns a closure apparatus having a lid which remains in a horizontal plane during movement between the closed position and then open position.

2. Prior Art

Closures or lid assemblies of the type especially adapted for use in connection with portable containers are well known. A familiar application concerns devices particularly devised for storage and transporting of food and drink. Commonly referred to as ice chests or coolers, the devices are frequently employed for personal use such as associated with picnics, spectator events and travel.

The traditional ice chest or cooler includes an insulated container or receptacle for receiving food and drink. Ice, usually in form of cubes, are added either to maintain temperature or prevent spoilage. The access opening in the container, generally located at the top, is normally sealed with an openable lid. Customarily, the device is provided with one or more carrying handles or straps.

Various sorts of closure structures are commonly associated with commercially available devices of the type of immediate interest. Especially popular, particularly in combination with rectangular containers, in a generally flat, panel-like lid which is hingedly coupled along an edge to an upper edge of the receptacle. An oppositely located hasp structure holds the lid in the closed position.

Another popular closure structure includes a lid which extends upwardly inward from opposite edges to a centrally located handle. Ears, depending from opposite ends of the lid, are pivotally affixed to respective sides of the receptacle. Cylindrical coolers are generally fitted with removable lids which either frictionally or threadily engage the receptacle.

Understandably, prior art closure structures adequately serve the primary function of closing the receptacle and inhibiting thermal loss. However, such apparatus have not proven to be entirely satisfactory. For example, prior art lids generally require substantial manual manipulation to open and to close. Frequently, both hands of the user must be employed simultaneously. Accordingly, any items which are to put into or retrieved from the cooler must be temporarily removed from the grasp of the user. In addition to the inconvenience, a temporary resting place is not always immediately available.

The flat, generally horizontal top of panel-like lids provides an inviting and readily usable surface upon which food items are frequently held during use or preparation. However, panel-like lids tilt during opening and closing. Resultingly, any items resting upon the lid must be removed each time access to the cooler is desired.

It would be highly advantageous, therefore, to remedy the foregoing and other deficiencies inherent in the prior art.

Accordingly, it is an object of the present invention to provide improvements in closure structures.

Another object of the invention is the provision of an improved closure structure of the type especially adapted for portable containers as exemplified by ice chests and coolers.

And another object of the invention is to provide a closure structure that is especially easy and convenient to manipulate.

Yet another object of this invention is the provision of a closure structure having a lid which presents a readily usable placement and holding surface.

Still another object of the invention is to provide a closure structure having a lid upon which items may remain during opening and closing.

Still another object of the immediate invention is the provision of a closure structure which can be handily operated by a single hand of a user.

And a further object of the invention is to provide a closure structure having ameliorated sealing means between the lid and the receptacle.

Yet a further object of the immediate invention is the provision of a closure structure having means for inherently effecting a seal between the lid and the container.

Still a further object of the invention is to provide a closure structure which is adaptable for use on selected prior art receptacles and containers.

And yet a further object of the invention is the provision of a closure structure of the foregoing character that is relatively inexpensive to manufacture yet exceeding durable and maintenance free.

SUMMARY OF THE INVENTION

Briefly, to achieve the desired objects of the instant invention in accordance with a preferred embodiment thereof, first provided is a lid and pivot means for affixing the lid to a receptacle for pivotal movement between a closed position and an open position. During movement, the plane of the lid remains horizontal. Next provided are seal means including an element of a male/female engagement pair extending continuously along the upper edge of the side wall of the receptacle and a complemental element of the male/female engagement pair carried by the lid. Biasing means normally retain the element in mating engagement with the complemental element when the lid is in the closed position. Also provided are cam means for disengaging the element from the complemental element as the lid is moved from the closed position toward the open position.

In accordance with a more specific embodiment of the invention, the pivot means includes a bracket extending inwardly from the side wall of the container and a pintle extending through the lid and the bracket. A compression spring urges the pintle downwardly to exert force upon the lid and thereby retain the lid in the closed position. One element of the seal means is in the form of a continuous bead. The other element of the seal means is in the form of a continuous groove for matingly receiving the bead. As the lid is pivoted about the pintle toward the open position, the bead cams against the groove to oppose the action of the spring and lift the lid from the upper edge of the receptacle. The invention may further include a hasp for holding the lid in the closed position.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings, in which.

DETAILED DESCRIPTION OF THE PREFERRED EMBODIMENTS

Figure 1:
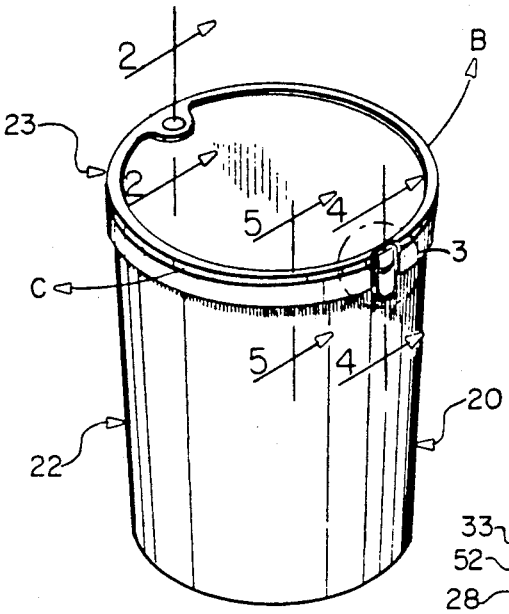
FIG. 1 is a perspective view of a container including a receptacle and a closure apparatus constructed in accordance with the teachings of the instant invention.
Figure 2:
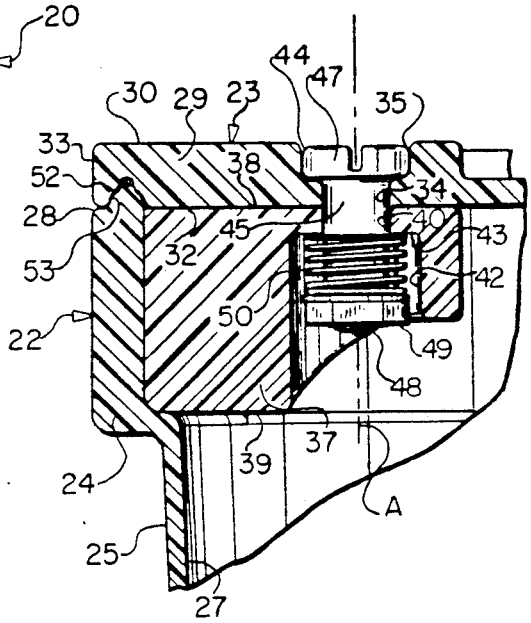
FIG. 2 is an enlarged fragmentary elevational view taken along the line 2—2 of FIG. 1.

Turning now to the drawings in which like reference characters indicate corresponding elements throughout the several views, attention is first directed to FIG. 1 which illustrates a container generally designated by the reference character 20 including a receptacle and a closure apparatus, generally designated by the reference characters 22 and 23, respectively. Receptacle 22, as seen with further reference to FIG. 2, includes an upstanding continuous side wall 24 having outer surface 25 and inner surface 27. At the upper end, side wall 24 terminates with edge 28 which circumscribes and defines an open end in receptacle 22. Although not specifically illustrated, but as will be readily appreciated by those skilled in the art, receptacle 22 further includes a bottom or closed end at a location spaced from upper edge 28.

Closure apparatus 23, in accordance with the immediately preferred embodiment thereof, includes generally rigid panellike lid 29 having top surface 30, bottom surface 32 and peripheral edge 33. Lid 30 is sized to span the open end of receptacle 22 and rest upon the upper edge 28 of side wall 24. Preferably, peripheral edge 33 is congruent with outer surface 25. At a location near peripheral edge 33, bore 34 extends through lid 29. Counterbore 35, concentric with bore 34, extends inwardly from the top surface 30.

Projection 37 having top surface 38 and bottom surface 39 extends inwardly from a side wall 24. Bore 40 extends through projection 37. Counterbore 42 extends into projection 37 from bottom surface 39 concentric with bore 40 and forming shoulder 43 therebetween.

Pintle 44 extends through lid 29 and projection 37. More specifically, pintle 44 includes shank 45 rotatably journaled within bores 34 and 40. Head 47, carried at one end of shank 45, resides within counterbore 35. At the other end, shank 45 terminates with threaded portion 48 residing within counterbore 42. Nut 49 is threadedly engaged with the threaded portion 48. Compression spring 50 encircles shank 45 and is held in compression between nut 49 and shoulder 43.

Bores 34 and 40 and pintle 44 are coaxial along the axis represented by the broken line A. Accordingly, lid 29 is pivotally moveable relative receptacle 22 in either direction indicated by the arcuate arrowed lines B and C. In the closed position illustrated continuous bead 52, projecting upwardly from edge 28 of side wall 24, is matingly received within groove 53 formed in the undersurface 32 of lid 29. Further description of bead 52 and groove 53 will be made presently.

Figure 4:
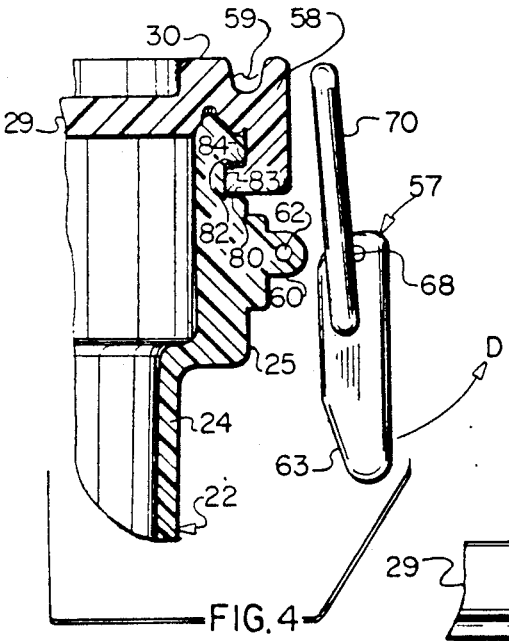
FIG. 4 is an enlarged fragmentary vertical sectional view taken along the line 4—4 of FIG. 1, parts thereof being exploded for purposes of illustration.
Figure 3:
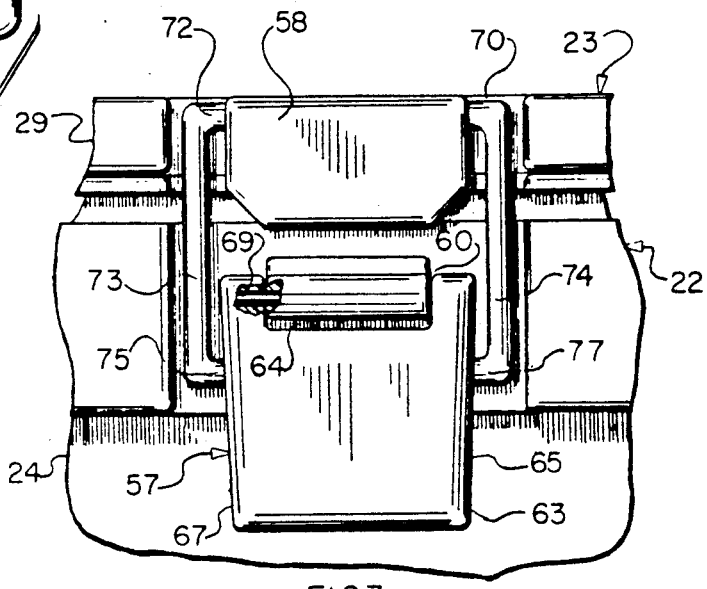
FIG. 3 is an enlarged fragmentary elevational view taken from within the area designated by the broken line circle 3 in FIG. 1, a portion thereof being broken away for purposes of illustration.

Closure structure 23 further includes a hasp for retaining lid 29 in the closed position. Reference is now made to Figs. 3 and 4 which illustrate a preferred hasp, generally designated by the reference character 57 including a tab 58 projecting outwardly from lid 29 and having recess 59 formed in the upper surface thereof. Lug 60 having bore 62 therethrough projects outwardly from sidewall 24 of receptacle 22 at a location spaced below tab 58. Preferably, bore 62 extends along an axis which is substantially perpendicular to the axis A which is the axis of rotation of lid 29.

Hasp 57 further includes flap 63 having recess 64 therein which receives lug 60. Flap 63 further includes a pair of spaced apart longitudinal edges 63 and 67 and a transverse bore 68 extending therebetween within the area of recess 64. Pin 69 extends through the bores 62 and 68 to pivotally couple flap 63 to receptacle 22, for movement between a secured position as shown and a release position in the direction of arrowed line D. Latching element 70 interacts between tab 58 and flap 63 to retain lid 29 in a closed position. An inverted generally u-shaped member, latching element 70 includes transverse leg 72 extending between depending legs 73 and 74 which terminate with inwardly directed terminal portions 75 and 77, respectively, which pivotally engage flap 63 from the respective sides 67 and 65. Transverse leg 72 is sized to be received within recess 59.

The function of hasp 57 is analogous to that of an over-the-center toggle as will be readily understood by those skilled in the art. In the secured position, latching element 70 is under tension. Since the pivotal securement between flap 63 and lug 60 is outboard of the pivotal securement between latching element 70 and flap 63, flap 63 is held inwardly against sidewall 24 in the secured position. When flap 63 is pivotally moved in the direction of arrowed line D, latching element 70 is released from recess 59 to be swung outwardly from tab 58 whereby lid 29 is free to be moved.

Hasp 57 is especially devised for securely retaining lid 29 in the closed position during harsh handling such as transportation. For temporarilY retaining lid 29 in the closed position and for providing convenient access to the container, closure apparatus 23 is preferably provided with a clasp including inwardly directed finger 80 having surface 82 and carried by tab 58. Also provided is recess 83 in outer surface 25 of sidewall 24 and having surface 84. When finger 80 is received within recess 83 surface 84 opposes surface 82 to hold lid 29 downwardly with bead 52 engaged within groove 53. Frictional engagement between the surfaces retards rotational movement of lid 29 relative receptacle 22.

Preferably, recess 83 includes a surface which extends upwardly outwardly from either side of surface 84 to function as a ramp for engaging surface 82 for camming finger 80 downwardly to ensure snug engagement of lid 29 in the closed position.

Figure 5:
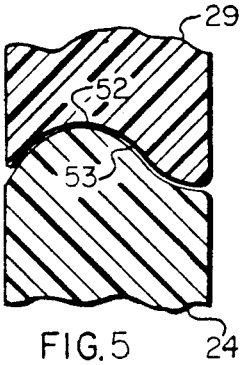
FIG. 5 is an enlarged fragmentary vertical sectional view taken along the line 5—5 of FIG. 1, the elements thereof being shown in the closed position.

The mating engagement between groove 53 and bead 52 is clearly seen in FIG. 5. Bead 52 and groove 53, which are held in mating engagement in response to the biasing of compression spring 50, function to retain lid 29 in alignment with the edge 28 of sidewall 25 during the closed position. The engagement also functions as a seal to retard thermal transfer through what would otherwise be a line-of-sight contact area between undersurface 32 of lid 29 and edge 28 of sidewall 24.

Figure 6:
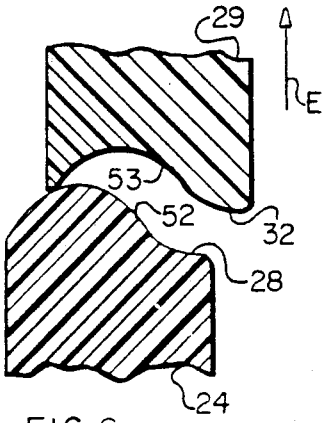
FIG. 6 is a view generally corresponding to the illustration of FIG. 7 and illustrating the elements thereof as they would appear during initial movement toward the open position.

As further seen in FIG. 6, bead 52 also functions as a cam for a cam follower which is defined as the apex between groove 53 and surface 32. It is apparent that two such apexes or cam followers are defined, one on either side of groove 53. In response to movement of lid 29 in either direction B or C, the appropriate cam follower rides upwardly upon bead 52 to raise lid 29 as indicated by the arrowed line E. Concurrently, in response to movement in either direction B or C, surface 82 of finger 80 is disengaged from surface 84 of recess 83. The movement of lid 29 is easily accomplished in response to appropriate manual pressure.

Figure 8:
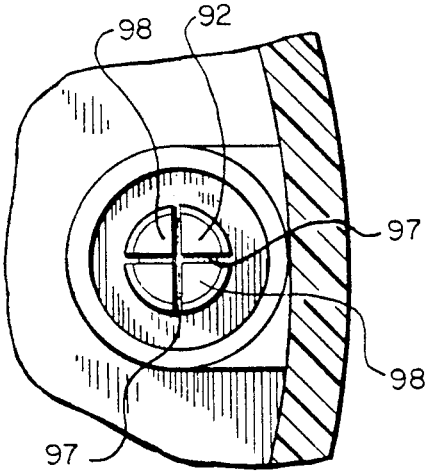
FIG. 8 is a horizontal sectional view taken along the line 8—8 of FIG. 7.
Figure 7:
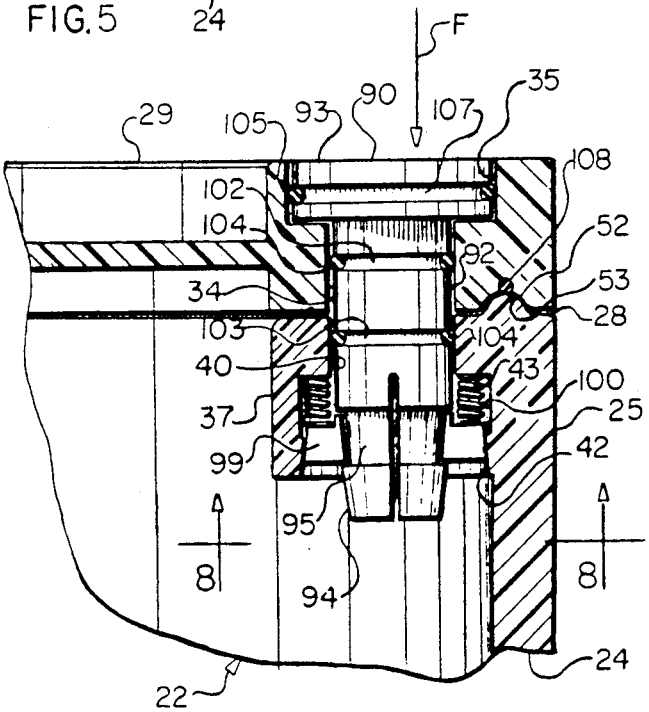
FIG. 7 is a view generally corresponding to the view of FIG. 2 and showing an alternate embodiment thereof.

An alternate pintle 90 for pivotally securing lid 29 to receptacle 22 is illustrated in FIG. 7. In accordance with the immediately preferred embodiment thereof, pintle 90 includes shank 92 which is rotatably journaled within bores 34 and 40. Head 93, carried at one end of shank 92, is received within counterbore 35. At the other end, shank 92 terminates with frustoconically tapered portion 94 and angular groove 95 which is spaced from the end. A pair of angularly disposed slits 97, as seen with further reference to FIG. 8, extend inwardly from the end of shank 92 to divide at least frustoconical portion 94 and groove 95 into a plurality of fingers 98. Collar 99 is retained upon shank 92 by groove 95. It will be appreciated by those skilled in the art, fingers 98 deflect inwardly for the passage of collar 99 to be received in snap engagement within groove 95. Compression spring 100 encircling shank 92 bears against shoulder 43 and collar 99 to urge downward pressure upon pintle 90 and subsequently lid 29.

First and second angular grooves 102 and 103, respectively, are formed in shank 92. A torroidal seal 104, preferably a conventional commercially available O-ring, resides in each of the angular grooves 102 and 103. Groove 102 resides in the area of bore 34 while groove 103 resides in the area of bore 40. Hence, shank 92 is sealingly engaged with the bores 34 and 40. Similarly, head 93 is sealingly engaged with counterbore 35 by virtue of torroidal seal 105 residing within angular groove 107.

Complementing the seals carried by the pintle, the immediate embodiment of the closure apparatus further includes an ameliorated seal between groove 53 and bead 52. Preferably, in accordance with the immediately preferred embodiment of the invention, an annular seal 108, which may be in the form of a conventional O-ring is carried within an appropriately sized and shaped groove 52. Seal 108 sealingly engages bead 53 when lid 29 is in the closed position.

Figure 9:
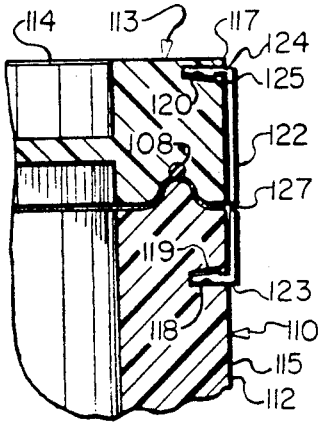
FIG. 9 is a view generally corresponding to illustration of FIG. 5 and showing another alternate embodiment thereof.

FIG. 9 illustrates an alternate embodiment of the invention including receptacle 110 having sidewall 112 and closure apparatus 113 including lid 114. Sidewall 112 includes outer surface 115 while lid 114 includes peripheral edge 117. For details not specifically illustrated and described, reference is made to the detailed description of the prior embodiments.

In accordance with the immediately preferred embodiment, an annular groove 118 is formed into sidewall 112 from the outer surface 115 thereof. Groove 118 includes an inwardly directed circumferential shoulder 119 which opposes surface 115. A mirror image groove 120 is carried by lid 114 in parallel-spaced relationship to groove 118. Cylindrical band 122, encircling the container, terminates with inwardly projecting flanges 123 and 124, respectively, which are received within the grooves 118 and 120, respectively. Each flange 123 and 124 includes an outwardly directed shoulder 125 which engages the respective shoulder 129 to retain the band 122 in engagement with the sidewall 112 and the lid 114. Accordingly, the closure apparatus is securely held in the closed position to prevent accidental opening where it is anticipated that the container will be subjected to exceptionally rough handling, such as during long distance transportation, or to ensure the integrity of the contents. Impression 127 formed in band 122, preferably in alignment with the juncture between the top edge of sidewall 122 and the bottom edge of lid 114, facilitates opening. It is anticipated that a deliberate action, such as cutting with a knife, is required to sever the band 122.

Figure 10:
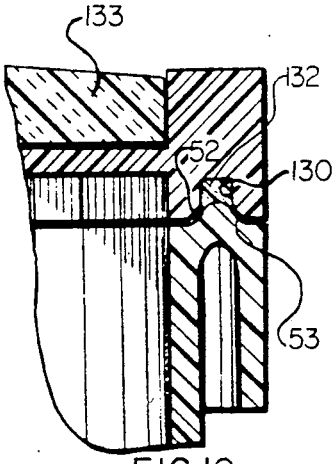
FIG. 10 is a view generally corresponding to the illustration of FIG. 5 and showing yet another alternate embodiment thereof.

Greater sealing between the lid and the edge of the receptacle is achieved in accordance with the embodiment illustrated in FIG. 10. A generally rectangular seal groove 130 is formed into groove 53 at a generally central location to carry annular seal 132. The seal 132 receives a substantial portion of bead 135 over a greater surface area than the previously described seal 108. The immediate embodiment is further enhanced by insulative material 133, such as foamed plastic, which fills the recess within the lid.

Figure 11:
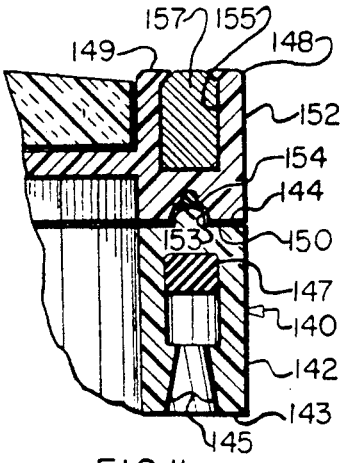
FIG. 11 is a view generally corresponding to illustration of FIG. 5 and showing still another alternate embodiment thereof.

FIG. 11 illustrates yet another closure apparatus embodying the principles of the instant invention and generally designated by the reference character 140. Especially adapted to be detachably secured to a selected pre-existing vessel, such as a convention bucket or pail, the immediate embodiment includes body 142 having lower edge 143 and upper edge 144. Groove 145 formed into body 142 from lower edge 143 receives the upper portion of the sidewall of the selected vessel. Seal 147 receives the upper edge of the side wall for sealing engagement between the vessel and body 142. Body 142, which is continuous, is sized and shaped as appropriate to receive the vessel. Further, body 142 may be secured to the vessel by various means. Exemplary is friction fit within the groove 145 or the use of conventional bonding agents.

Closure apparatus 140 further includes lid 148 which in general similarity to the previously described embodiments, includes top surface 149 undersurface 150 and a peripheral edge 152. Lid 148 further includes continuous groove 153 formed into under surface 150 which matingly receives bead 154 upstanding from edge 144 of body 142. In all other aspects, including the pivotal securement to body 142, lid 149 is structurally and functionally analogous to the previously described embodiments.

Further in accordance with the immediate embodiment of closure apparatus 140, a generally cylindrical groove 155 is formed into lid 148 from the top surface 149 at a location near peripheral edge 152. Reinforcing member 157 is carried within groove 155. Closure apparatus 140, in general similarity to the previously described embodiments, is preferably fabricated of a plastic material especially chosen to have insulative properties. For purposes of adding rigidity to the lid, reinforcing member 157 is preferably fabricated of metal. It is understood that such a reinforcing member may be used in combination with the previously described embodiments of the invention.

Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A closure apparatus especially adapted for use in combination with a receptacle, said receptacle including an upstanding sidewall having an upper edge defining an open end in said receptacle, and for normally closing said receptacle and for providing improvements in access to said receptacle, said closure apparatus comprising:

(a) a lid;

(b) pivot means pivotally affixing said lid to said receptacle for rotational movement about a vertical axis, from (i) a closed position, to (ii) an open position;

(c) seal means including (i) an element of a male/female engagement pair extending continuously along the upper edge of the sidewall of said receptacle, and (ii) a complemental element of said male/female engagement pair carried by said lid;

(d) biasing means normally retaining said element in mating engagement with said complemental element when said lid is in the closed position; and cam means opposing said biasing means for disengaging said element from said complemental element as said lid is moved from the closed position toward said open position.

* * * * *